United States Patent [19]

Binstock

[11] 4,068,475

[45] Jan. 17, 1978

[54] FLOW CONTROL FOR ONCE-THROUGH BOILER HAVING INTEGRAL SEPARATORS

[75] Inventor: Morton H. Binstock, Pittsburgh, Pa.

[73] Assignee: Westinghouse Electric Corporation, Pittsburgh, Pa.

[21] Appl. No.: 678,525

[22] Filed: Apr. 20, 1976

[51] Int. Cl.[2] ..... F01K 13/02

[52] U.S. Cl. ..... 60/646; 60/665; 122/406 S; 122/406 ST

[58] Field of Search ..... 60/646, 664, 665, 656; 122/406 S, 406 SU; 290/2, 40

[56] References Cited

U.S. PATENT DOCUMENTS

| | | | |
|---|---|---|---|
| 3,464,393 | 9/1969 | Chambert | 122/406 S |
| 3,789,806 | 2/1974 | Govzegho | 122/406 S |
| 3,954,087 | 5/1976 | Stevens et al. | 122/406 S |

*Primary Examiner*—Allen M. Ostrager
*Assistant Examiner*—Stephen F. Husar
*Attorney, Agent, or Firm*—E. F. Possessky

[57] ABSTRACT

A once-through boiler is provided with integral separators with which drain valves are associated. Boiler inlet and outlet flows are balanced throughout startup first by drain valve control in response to separator level and then by drain valve control in response to throttle pressure.

10 Claims, 7 Drawing Figures

FLOW CONTROL FOR ONCE-THROUGH BOILER HAVING INTEGRAL SEPARATORS

CROSS-REFERENCE TO RELATED APPLICATIONS

Ser. No. 678,526 entitled, "Improved Valve Sequencing Startup Control System For Once-Through Boiler", assigned to the present assignee and filed by the present inventor concurrently herewith, now U.S. Pat. Nos. 4,019,467.

BACKGROUND OF THE INVENTION

The present invention relates to electric power plants and more particularly to flow controls for once-through boilers.

It has been common to employ an off-stream flash tank for startup of a once-through boiler. For example, the boiler may be designed to provide 246.05 KGSC (kilograms per square centimeter) steam at the turbine during normal operation and the flash tank may be designed to supply steam at 70.3 KSGC for startup and operation of the turbine up to about 10% load. During all startups, a conventional V valve between the primary and secondary superheater is closed, and conventional P and N valves are open. Water is heated in furnace section and primary superheater passes and flows into the flash tank where the steam is separated from the water. The steam then flows back to the final superheater where additional heat is added before flowing to the turbine. The steam generated in this manner requires coordinated action to open the V valve, close a P valve, and modulate the firing rate and adjust the turbine valves to avoid interaction which could cause abrupt changes in steam temperature or pressure or turbine/-generator output. Operation with this type system has been satisfactory for base loaded units. However, the complex startup and shutdown procedure has made it unsuitable for cycling service.

More recently, an integral separator starting system has been developed for Foster-Wheeler once-through boilers, and it decreases the complexity of starting and increases the availability and cycling capacity of the once-through boiler. In this arrangement, the low pressure off-line flash tank is eliminated and a set of separators are installed in the main flow path upstream from the primary superheater. In this manner, provision is made for: (1) water to flow through the furnace tubes at a minimum rate to protect them from overheating; (2) diversion of water from the turbine to a drain flow path in which drain valves are provided reaches its normal operating range; and (3) a startup supply of steam until the boiler reaches its normal operating range.

In the integral separator startup system, a plurality of sets of valves are disposed upstream from the separators to control the waterwall pressure or the back pressure on the boiler feed pump as the boiler is ramped into operation. A set of W valves and a parallel set of Y valves have been coordinatively operated in the Foster-Wheeler boiler to control waterwall pressure as the boiler moves up to 25% load. Above 25% load, the W and Y valves are open. An additional set of PPR valves are also provided in parallel with the W and Y valves to provide finer waterwall pressure control over a lower pressure operating range.

During the boiler startup, as the boiler is fired to increase the operating pressure along a ramp, the separator drain valves are operated to produce the water drain flow needed to keep the separator water level at a setpoint value. The boiler inflow and outflow are impliedly balanced by the separator level control. When the boiler reaches a supercritical state, the fluid in the separators in supercritical and the drain valves are closed since the total boiler outflow can then be sent to the turbine without danger of water carryover.

The level control for the separator drain valves acts in response to a level detector which senses steam and water weights and uses the weights to generate a signal indicative of the steam-water interface, i.e. the water level. At 246.05 KGSC, the fluid is supercritical and the level detector is not usable since no steam-water interface exists. However, since the drain valves are closed, there is no need for level control at 246.05 KGSC and above.

In the transition pressure range below 246.05 KGSC pressure, control of the drain valves is needed for boiler flow balance, yet the level detector output is subject to error and therefore is not reliable for level control. In fact, the level measurement is unusable from 210.9 KGSC and up since it will produce a drain valve closure and a boiler flow imbalance, i.e. more inflow than outflow which causes a jump in the waterwall pressure from 210.9 KGSC to 249.57 KGSC, a chilling of the boiler water and a plant trip for turbine protection. There is accordingly a need for an improved control which provides for smooth and reliable startup of once-through boilers having integral separators.

SUMMARY OF THE INVENTION

A startup control for a once-through boiler having integral separator means includes a drain flow control responsive to separator level over a first pressure range and a drain flow control responsive preferably to throttle pressure at higher pressures where level detection becomes invalid thereby reliably and smoothly balancing boiler inflow and outflow over the entire startup range.

DESCRIPTION OF THE PREFERRED EMBODIMENT

Power Plant

Figure 1:
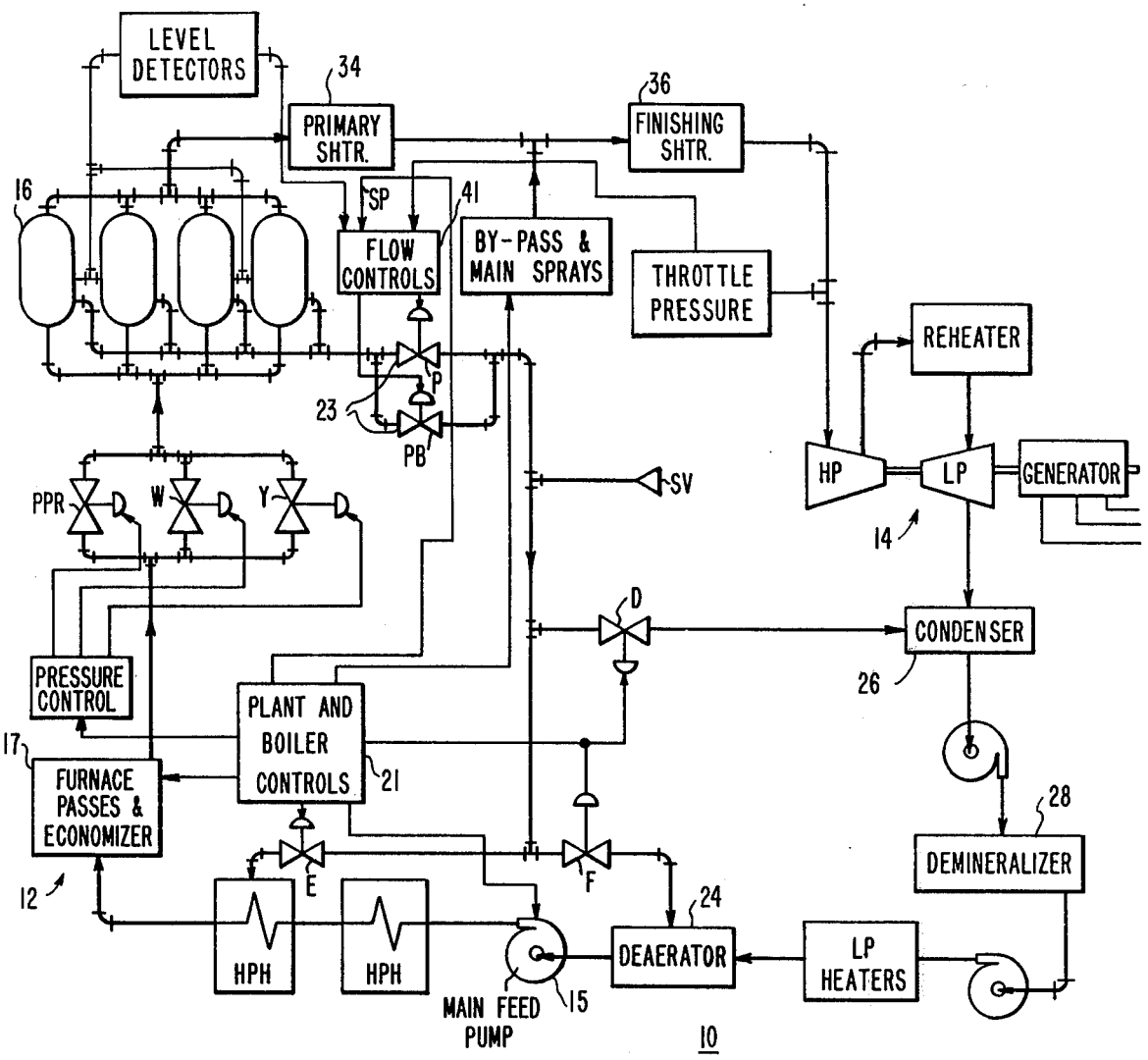
FIG. 1 shows a block diagram of an electric power plant in which the invention is implemented.

More particularly, there is shown in FIG. 1 a schematic diagram of an electric power plant 10 in which a once-through boiler 12 is started to generate steam for driving a turbine-generator 14 in accordance with the principles of the invention. The boiler 12 is an integral separator startup type made by Foster-Wheeler Corporation.

The boiler includes a plurality of separator units 16, in this case thirty-two units, connected in parallel in the outlet flow path from a furnace 17 which heats the fluid.

A boiler feed pump 15 drives the fluid through the system. During startup, the working fluid is separated into turbine steam and return water flow until the operating level of the furnace reaches the point where the outlet fluid reaches supercritical pressure and temperature, at which time essentially no water exists for separation.

Figure 2A:
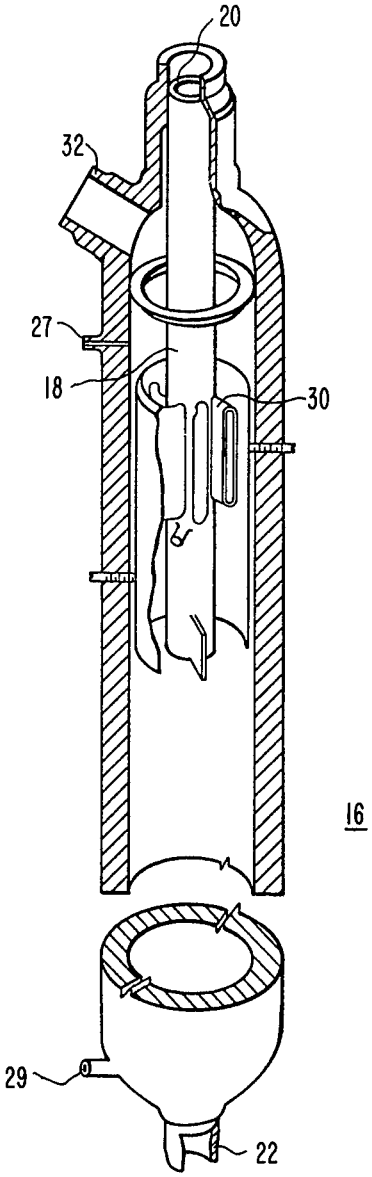
FIG. 2A shows a cutaway view of a separator used in the once-through boiler employed in the plant.

Each separator unit 16 (FIG. 2) includes a central tube 18 into which fluid flows through an inlet 20. Water outflow from the tube 18 passes through an outlet 22 to separator level and pressure controlled drain valves 23 (FIG. 1) for return to a deaerator 24. Steam in the drain flow returns through a condenser 26 and demineralizer 28. Detector tubes 27 and 29 provide coupling connections between a level detector and the separator.

In the tube 18, fluid passes to spiral arms 30 where water and steam are separated by centrifugal action. The steam rises for outflow through a top nozzle 32 to a primary superheater 34 and a final superheater 36 and the water flows to the drain outlet 22. When the fluid reaches a supercritical state, there is no water and the drain valves 23 are closed to cause all entering fluid to pass through the nozzle 32.

Figure 3:
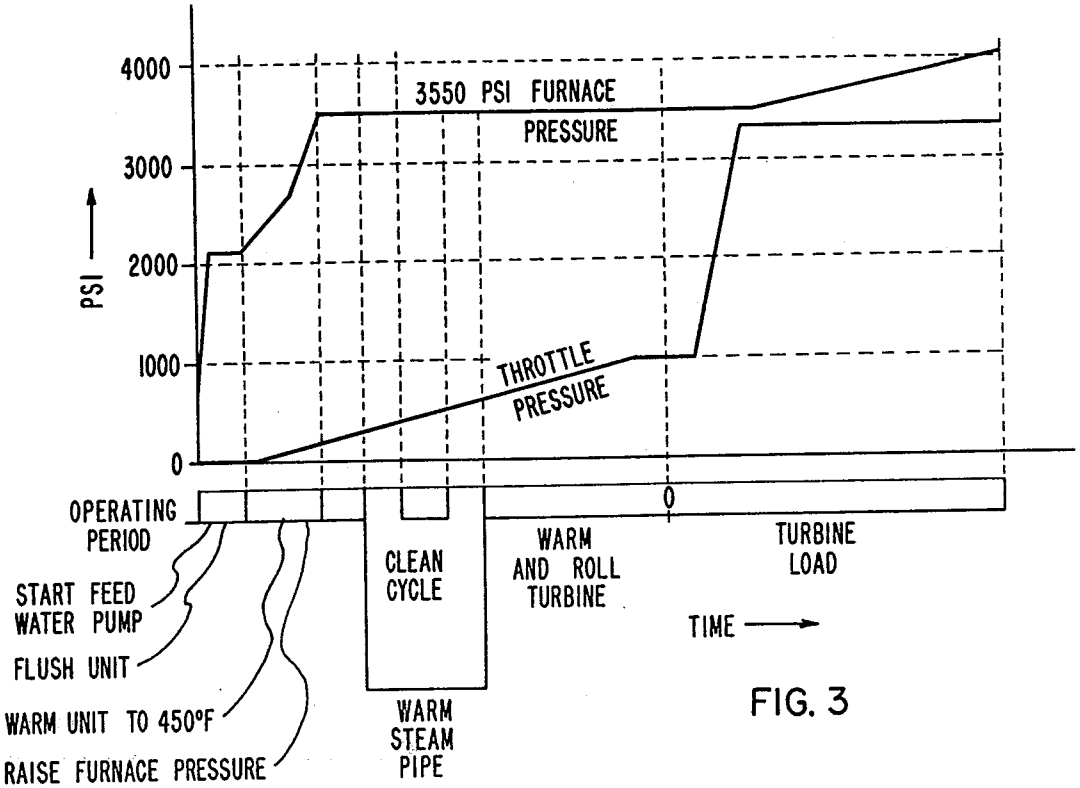
FIG. 3 illustrates the pressure operation of the plant.

As illustrated in FIG. 3, a full startup cycle of the plant comprises:

1. cold water flushing — to clean the piping;
2. warmup of the water and initial operation, to approximately 70.3 KGSC and 7% load — steam for the turbine at this time is supplied by the steam separator;
3. pressure ramp — the transition zone from 70.3 KGSC pressure at 7% load with steam being supplied by the separator to 246.05 KGSC supercritical once-through operation at 25% load; and
4. full pressure operation consisting of the range from house load to 100% load to 246.05 KGSC supercritical once-through operation.

Boiler Startup Process

More specifically, at the beginning of the warmup cycle, fuel is fired into the boiler and controlled by the operator through a boiler control 21 (FIG. 1). Feedwater flow remains at 15% until the furnace pass outlet temperature reaches 232.22° C, at which time feedwater flow is gradually and automatically ramped from 15% to 25%. During this ramp time, fuel flow is automatically boosted to prevent a sag in fluid temperature otherwise resulting from increased water flow.

During the pressure ramp mode, pressure is controlled by the firing rate as in a conventional boiler. In the once-through cycle, pressure is basically the ratio between the fluid out of the process (steam) and the water into the process (feedwater). Therefore, if the pressure tends to sag, pressure controls index up the water flow to increase pressure as well as the fuel flow to maintain temperature.

As the water continues to heat, separator pressure increases. At approximately 35.15 KGSC there is adequate pressure to roll and synchronize the turbine to 3% load. Fluid is then being removed from the separator in two forms, i.e. as water through the P/Pb valves 23 and as steam through the turbine 14. Therefore, to maintain the same level within the separator 16 as steam flow increases, the P/Pb valves 23 close to reduce the water drainage flow. Firing continues until approximately 70.3 KGSC is achieved at 7% load.

The power plant is ready for the pressure ramp at this point. The purpose of the ramp is to allow a smooth and orderly transition from separator steam pressure operation to supercritical once-through operation.

Waterwall pressure is automatically controlled during the ramp by three sets of valves, i.e. the PPR valves, the W valves, and the Y valves. In this specific plant, there are four PPR valves which are relatively small fine vernier pressure control valves. The W valves are larger pressure control valves and the two Y valves provide coarse pressure control.

Initially, waterwall pressure is controlled by the fine vernier PPR valves. One of the valves is automatically forced open prior to startup with pressure at approximately 140.6 KGSC. As the density of the water decreases due to warmup and the water flow increases from 15 to 25%, the waterwall pressure starts to rise. When the pressure increases to 246.05 KGSC the second PPR valve is opened. To prevent cycling, a deadband is provided to prevent the valve from closing unless the pressure drops to 210.9 KGSC. Continued boiler firing causes the pressure again to reach 249.57 KGSC and the third PPR valve opens. This process continues until all four PPR valves are opened. The PPR valves are then no longer capable of providing automatic control.

Continued increase in waterwall pressure sequences the W valves open. These valves regulate pressure at 249.57 KGSC, which is 3.52 KGSC higher than the setpoint for the PPR valves to assure proper sequential operation. When both W valves reach a total position greater than 80% and therefore are about out of range, the larger Y valves are pulsed open. The Y valve opening action results in a drop in pressure to cause the W valves to close partially. Continued pressure buildup again causes the W valves to move again in the open direction. When the W valves reach a combined total position of 80%, the Y valves are again pulsed open. This process continues, and when full pressure operation is achieved, the two W valves and the two Y valves are 100% open.

A load demand computer 25 (FIG. 3) gradually ramps the pressure and load from 70.3 KGSC — 7% load to 246.05 KGSC — 25% load. During the ramp, the turbine valve manual/automatic station remains at 25% and the boiler master fuel demand increases the demand for fuel. This increases the firing rate which, in turn, increases steam pressure and generated megawatts. Steam pressure is controlled by the steam pressure control system and the pressure setpoint is continually updated by the load demand computer 25.

Drain Flow Control

As steam pressure continues to rise, more and more fluid from the steam separator 16 leaves as steam through the turbine 14. This tends to cause a drop in separator level which is counteracted by the closure of the P/Pb valves 23 by a flow control 41 as the pressure ramp progresses. At the top of the pressure ramp, the P/Pb valves 23 are totally closed by the control 41, at which time the boiler 12 is operating as a once-through supercritical boiler.

The P/Pb valves 23 are controlled throughout the pressure ramp to maintain separator level until a pressure of approximately 210.9 KGSC is reached. At this point, the fluid within the separator 16 is approaching the supercritical point and the level measurements become invalid. This could normally cause premature closing of the P/Pb valves 23 which would force the system to become a once-through boiler instantly rather than allowing the continuation of a smooth ramp. To avoid this occurance, the control for the P/Pb valves 23 is transferred from level regulation to pressure regulation.

The ramping process continues until the load demand computer 25 indicates a 25% load point: The separator 16 is then filled with supercritical fluid, the P/Pb valves are closed, and all waterwall pressure control valves are opened and the power is at 246.05 KGSC, 25% load.

Several different controls act coordinatively on the P/Pb valves 23. During warmup, separator level is controlled by the P/Pb valves 23. The P/Pb valves 23 are drain valves for the separator, and an excessive separator level opens them. During initial warmup and ramp phases, 25% water is pumped into the separator 16 and 25% water leaves through the P/Pb valves. As turbine load increases, less fluid flows through the P/Pb valves 23 and more fluid flows through the turbine 14 as steam until at full pressure the P/Pb valves 23 are closed.

During initial warmup and pressure ramp, the P/Pb valves 23 control separator level and toward the end of the ramp they maintain pressure. During normal full pressure operation, the P/Pb valves 23 function as power operated overpressure control valves if the desired throttle pressure is exceeded. Thus, under abnormal conditions, the P/Pb valves 23 are capable of quickly opening to a maximum position of 70% to lower throttle pressure back to the normal value.

At loads less than 25% with full pressure, the feedwater flow is restricted to a minimum of 25%. Therefore, for loads less than 25% the difference between the 25% water and the steam flow is drawn through the P/Pb valves 23 to the condenser 26. The P/Pb valves 23 are characterized to drain the excess water.

Figure 4:
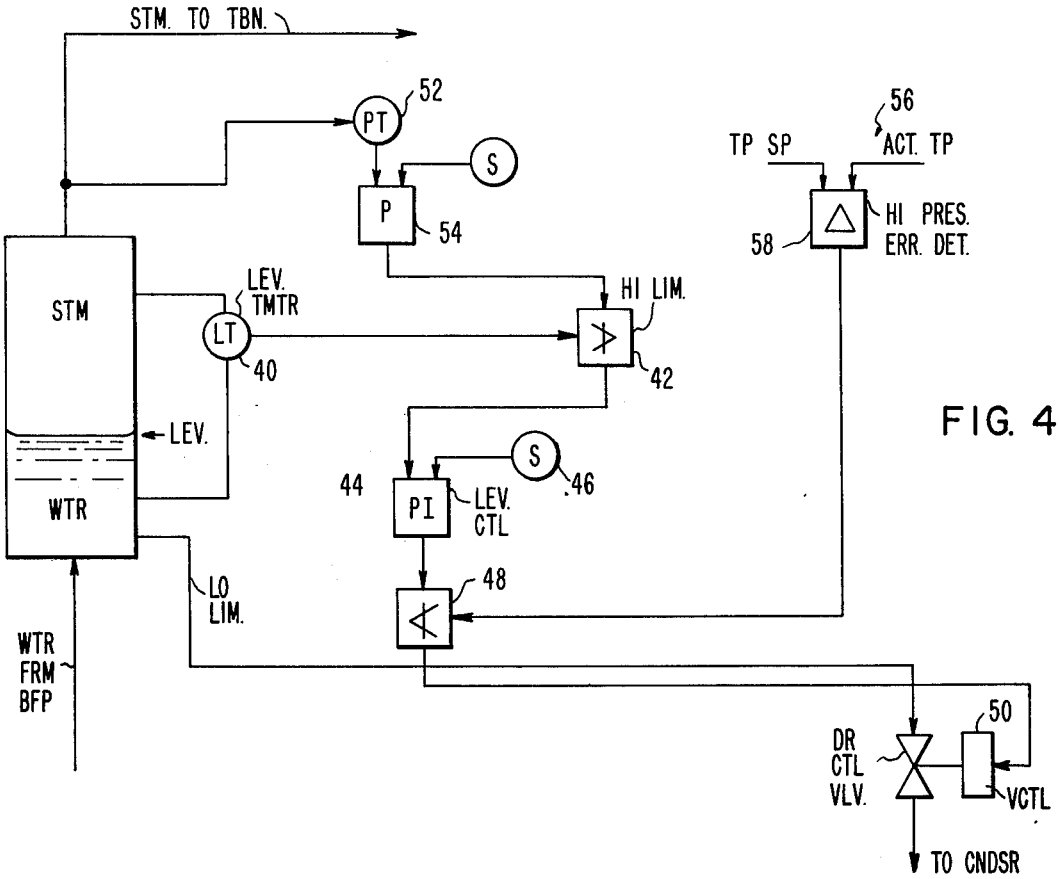
FIGS. 4–6 show functional block diagrams of separator drain valve controls arranged in accordance with the invention.

More particularly, as the boiler 12 is fired to increase pressure along a ramp, the boiler feed pump 15 is set at the specified minimal boiler flow of 25% and the turbine throttle valve is set at 25% flow. The drain flow control for each separator 16 balances the boiler inflow and outflow over a first pressure range in response to the separator level indicated by a signal from a conventional level transmitter 40. (FIG. 4).

The level signal is transferred through a high limiter block 42 to a proportional plus integral controller 44 where it is compared to a level setpoint 46. A resultant error signal is passed through a low limited block to a valve controller 50 which sequentially moves the two drain valves 23 associated with the separator 16 to produce a corrective change in the drain flow.

To provide smooth and reliable full range boiler flow control, a pressure transmitter 52 generates a signal representative of the separator outlet pressure. A proportional amplifier 54 generates an error signal representing the difference between the separator pressure and a pressure setpoint of 196.84 KGSC.

The output from the proportional amplifier 54 operates as the high limit for the high limiter 42 of the level signal. The high limit signal starts a ramped fall to zero value as the separator pressure reaches 196.84 KGSC and continues its upward ramp. Therefore, the high limiter 42 normally does not limit the level control signal up to about 196.84 KGSC but at 196.84 KGSC or at some point thereabove the level control signal is high limited along a ramp to zero before the pressure reaches 210.9 KGSC where level detection becomes invalid. A step change in the level control signal and a step closure of the drain valves 23 is thereby avoided to prevent a plant trip that would otherwise ensue.

Simultaneously, positive control is placed on boiler flow so that the boiler pressure ramp can continue reliably and safely until the boiler 12 reaches the supercritical state. Thus, actual throttle pressure is sensed by a suitable detector 56 which generates an actual throttle pressure signal for comparison to a throttle pressure setpoint in an error detector 58.

The throttle error output is applied as a low limit to the low limiter 48 to provide override control over the drain valves 23 after the level signal has been ramped downward to a value below the low limiting throttle pressure error. For the pressure range above the low limit crossover point, the throttle pressure error which exists as the boiler pressure continues its upward ramp is the controlling variable in the boiler flow balance produced by the flow control. When the endpoint throttle pressure is finally reached, the drain valves 23 will have been closed under the control of the throttle pressure error detector.

Figure 5:
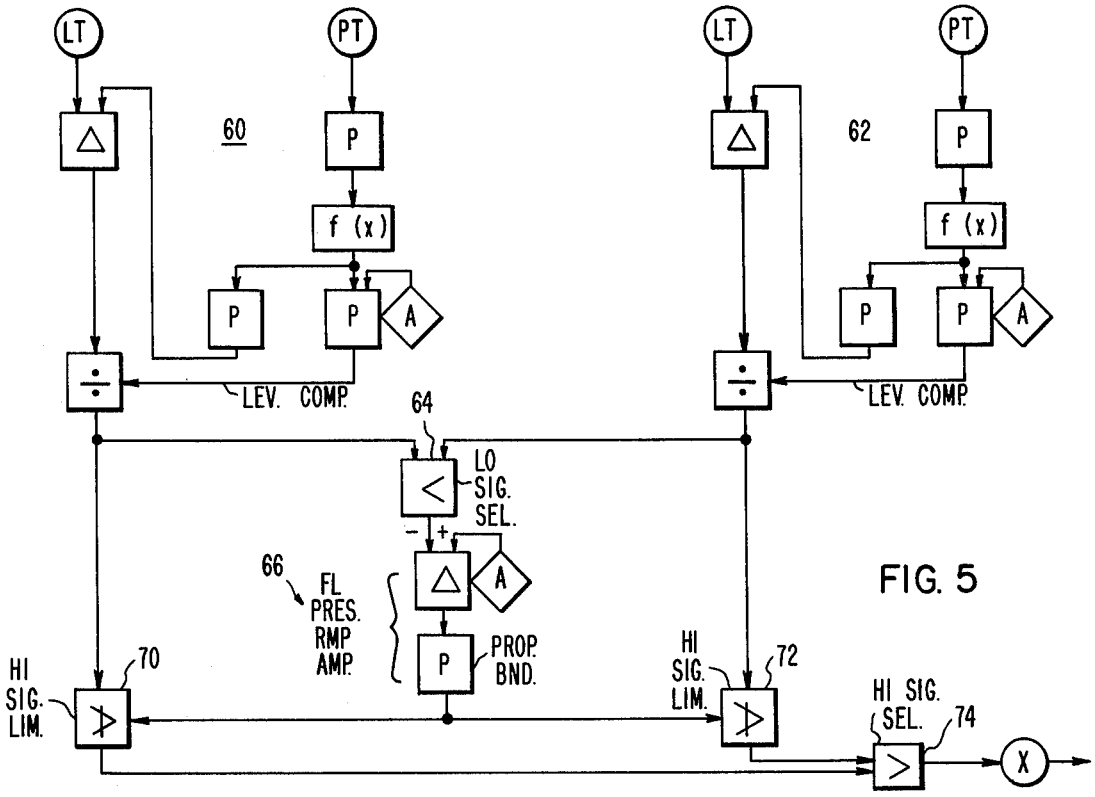

As shown more specifically in FIG. 5, a primary level detector 60 and a backup level detector 62 are provided for each separator 16. Level and pressure signals are transmitted to each detector 60 or 62 for computations, and pressure compensated level signal outputs are generated for low selection at block 64 and application to pressure ramp amplifier 66. Each level detector output is also applied to a block 70 or 72 which is high limited by the pressure error output from the amplifier 66 for reasons previously considered. The outputs from high limit blocks 70 and 72 are applied to a high selector block 74.

Figure 2B:
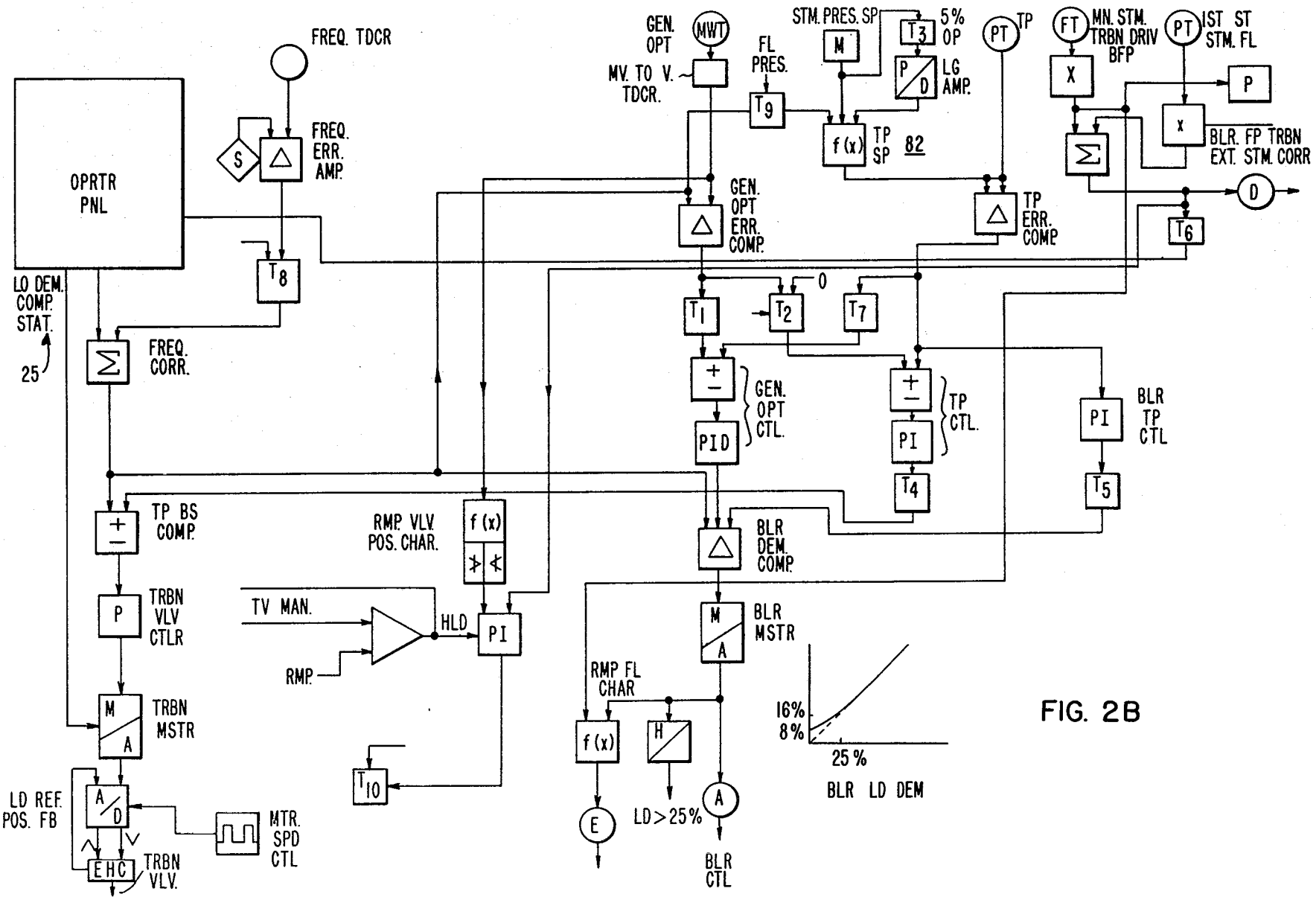
FIG. 2B shows a schematic diagram of a plant control at the highest hierarchical level of a control system for the plant.
Figure 6:
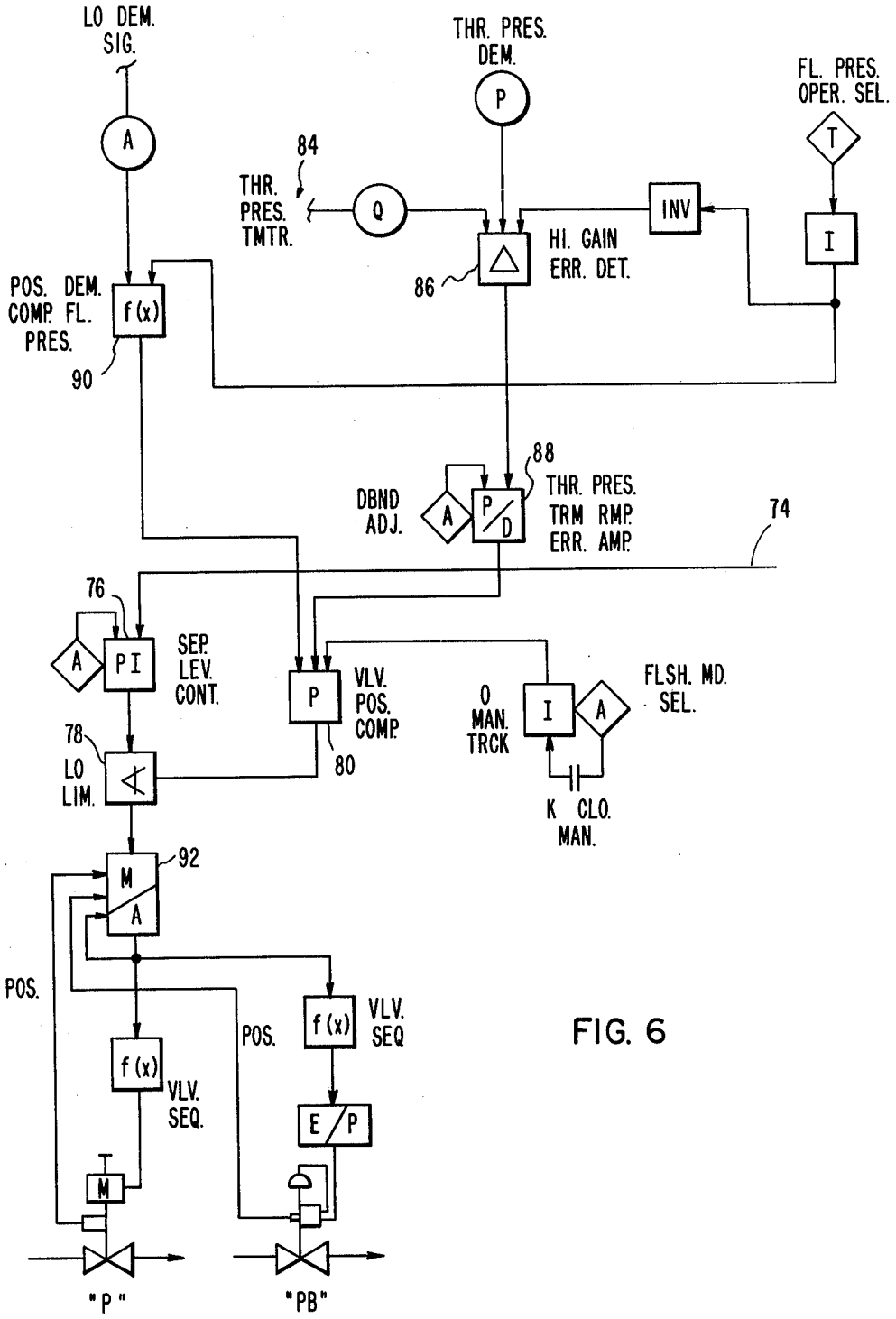

As shown in FIG. 6, the selected output level signal from the block 74 is applied to a PI level controller 76 where a setpoint of 121.9 cm is compared to it. The output from the controller 76 is applied to block 78 where it is low limited by throttle pressure error from a valve position computer 80. Throttle pressure demand is obtained from the throttle pressure demand computer 82 in the system shown in FIG. 2B, and it is applied along with the output of a throttle pressure transmitter 84 to an error detector 86. The throttle pressure error is applied to the valve position computer 80 through a trim block 88 to provide pressure control over separator drain flow and ultimately boiler flow balance during startup as already described. When full throttle pressure operation is reached, load demand from the boiler demand computer in FIG. 2B is applied through characterizer block 90 to the computer 80 to provide for drain valve opening on load drops.

A manual/automatic station 9 responds to operator panel switch selections to provide for automatic flow control of the drain valves 23 through sequences as described or to provide for manual drain valve control.

What is claimed is:

1. A startup system for a once-through boiler having a boiler feed pump for controllably driving water as a working fluid through the boiler tubes where heat is added to the working fluid under burner control, said system comprising separator means disposed in the main boiler flow path, means for detecting separator level, drain valve means for varying a drain flow from the separator means to balance boiler inflow and outflow during startup, first means for controlling said drain valve means for boiler flow balance during startup in response to a separator water level signal from said detecting means over a first working fluid pressure range up to a pressure below supercriticality, means for displacing said first control means from controlling effect at pressure above the first range and at a pressure below a pressure value at which the level signal becomes invalid, and second means for controlling said drain valve means for boiler flow balance during startup in response to a signal representative of at least one predetermined boiler operating parameter other than separator level at pressures above the first pressure range.

2. A system as set forth in claim 1 wherein the parameter is throttle pressure at the boiler output.

3. A system as set forth in claim 2 wherein means are provided for generating a separator level error relative to a level setpoint, and said displacing means includes means responsive to separator outlet pressure and a separator outlet pressure setpoint to reduce the level error increasingly as pressures rise above the first pressure range.

4. A system as set forth in claim 3 wherein said second controlling means overrides the controlling effect of the modified level error to position said drain valve means for boiler flow balance through throttle pressure control.

5. A system as set forth in claim 1 wherein said separator means includes a plurality of parallel separators and said first and second control means provide drain flow control for a drain flow from each separator.

6. A startup control for a once-through boiler having a boiler feed pump for controllably driving water as a working fluid through the boiler where heat is added to the working fluid under burner control and further having separator means in the main boiler flow path with drain valve means associated therewith, said control comprising means for detecting separator level, and first means for controlling said drain valve means for boiler flow balance during startup in response to a separator water level signal from said detecting means over a first working fluid pressure range up to a pressure below supercriticality, means for displacing said first control means from controlling effect at pressures above the first range and at at pressure below a pressure value at which the level signal becomes invalid, and second means for controlling said drain valve means for boiler flow balance during startup in response to a signal representative of at least one predetermined boiler operating parameter other than separator level at pressures above the first pressure range.

7. A control as set forth in claim 6 wherein the parameter is throttle pressure at the boiler output.

8. A control as set forth in claim 7 wherein means are provided for generating a separator level error relative to a level setpoint, and said displacing means includes means responsive to separator outlet pressure and a separator outlet pressure setpoint to reduce the level error increasingly as pressure rise above the first pressure range.

9. A control as set forth in claim 8 wherein said second controlling means overrides the controlling effect of the modified level error to position said drain valve means for boiler flow balance through throttle pressure control.

10. A control as set forth in claim 9 wherein a proportional amplifier generates a separator outlet pressure error, a high limiter employs the separator outlet pressure error as a high limit to modify the level signal, a proportional plus integral controller acts on the high limited level signal and the level setpoint to generate the level error signal, a throttle pressure error detector acts on the actual throttle pressure signal and the throttle pressure setpoint as it ramps upward during startup to generate the throttle pressure error, and a low limiter employs the throttle pressure error as a low limit on the level error to override the controlling effect of the level error on the drain valve means as the transition occurs from level control to throttle pressure control.

* * * * *